US006565431B1

(12) United States Patent
Villela

(10) Patent No.: US 6,565,431 B1
(45) Date of Patent: May 20, 2003

(54) FAN FOLD VENT

(75) Inventor: Edward C. Villela, Leonia, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/132,004

(22) Filed: Apr. 25, 2002

(51) Int. Cl.[7] ..... F24F 7/02
(52) U.S. Cl. ..... 454/365; 52/199
(58) Field of Search ..... 454/365, 367; 52/57, 199

(56) References Cited

U.S. PATENT DOCUMENTS

| | | | |
|---|---|---|---|
| 5,167,579 | A | 12/1992 | Rotter |
| 5,673,521 | A | 10/1997 | Coulton et al. |
| 5,971,848 | A | 10/1999 | Nair et al. |
| 6,039,646 | A | 3/2000 | Sells |
| 6,233,887 | B1 | 5/2001 | Smith |
| 6,267,668 | B1 * | 7/2001 | Morris ..... 454/365 |

* cited by examiner

*Primary Examiner*—Harold Joyce
(74) *Attorney, Agent, or Firm*—Imre Balogh; William J. Davis

(57) ABSTRACT

A fan fold vent for covering the opened ridge of a roof allowing ventilation of static air from an attic space of a building consisting of multiple vent sections connected by soft pliable hinges which allow the sections to fold on top of each other and form a stack for easy transportation and handling. The soft, pliable hinges are staggered at each junction of two vent sections, one hinge being on the top surface on the junction and the following hinge being on the bottom surfaces on the junction. Each vent section constitutes a unitary semi-rigid panel adjustable to the configuration of a roof and contains: a support structure on its bottom surface to prevent collapse or warping of the panel; and ventilation means for guiding air from the attic space to the exterior which includes: rows of vent slots and slats running longitudinally on two sides of the panel; and two vertical exterior baffles integral and running parallel with the rows of the slats to create a vacuum over the rows of slots and slats.

19 Claims, 10 Drawing Sheets

FAN FOLD VENT

BACKGROUND OF THE INVENTION

1. Field of the Invention

The present invention relates to roof ridge vents for covering an opening at a peak of a roof. More particularly, the invention relates to plastic roof ridge vents comprised of multiple sections of vents joined together with soft hinges for allowing the sections to fold into a fan configuration forming a stack prior to installation, and unfolding the multiple sections to lay flat on the ridge at installation.

2. Reported Developments

Ventilators for attics of building are perforated or baffled vent openings in the underside of the eaves of an overhanging roof or fascia and on the roof ridge overlaying the open roof along the length of the roof. The vent openings allow outside air to flow into the attic to equalize the interior attic temperature and pressure with that of the outside environment. This equalization helps to prevent degradation of the roof structure, reduces the accumulation of condensation in the insulating material covering the floor of the attic thereby increasing the efficacy of heating/cooling of the living space in the building covered by the roof structure.

The ventilator system of the prior art is typically comprising: a roof ridge ventilator and soffit ventilator. The roof ridge ventilator overlays the open roof along the length of the roof for exhausting the air form the space below the roof and the ceiling of the attic, i.e. as the air entering the attic through the soffit vent mixes with the warmer air in the attic, it has to be expelled through an opening in the roof ridge where the lighter, warmer air accumulates. Desirably, the volume of air intake through the soffit ventilator should be balanced by the volume of air exhaust through the roof ridge ventilator. In an optimum soffit ventilator/roof ridge ventilator system there is a balance between the net free open area presented by such system. The terminology "Net Free open Area" or NFA means the cross-sectional area of a ventilator system which is open for passage of air therethrough. The appropriate balance of the net free open area of a soffit ventilator and roof ridge ventilator is imperative. Thus, in many existing and newly built buildings there is a potential for an out of balance soffit roof ridge ventilation system.

Ventilation systems should also provide against insects entering the attic space of buildings. While larger perforations in the soffit and roof ridge ventilation panels would render the desired flow of air through the attic space, they would also allow ingress to insects therein to form insect colonies.

In addition to having good ventilation of the attic space and preventing ingress of water, snow and insects into the attic space, the desiderata in a ventilation system includes: structural strength and stability to withstand the effects of the elements, such as high wind; strong structural support against collapse or warping, such as occurs by the accumulation of snow or ice or by weight of the installers accidentally stepping on the roof ridge ventilator; easy handleability on installation; and low costs.

The present invention is directed to roof ridge ventilators which preferably are used in conjunction with an adequate soffit ventilator of the prior art.

Illustrative examples of the prior art directed to roof ridge ventilators include the following U.S. Pat. Nos.: 5,651,734, 4,676,147, 4,280,399, 5,457,920, 4,817,506, 5,095,810 and 5,458,538.

In addition to ventilating performance of roof ridge vents the prior art also addressed packaging/handleability, ease of installments on the site and economy of labor.

U.S. Pat. No. 5,167,579 discloses a roof vent of synthetic fiber matting. The mat is of unitary sheet construction of randomly aligned synthetic fibers joined by phenolic or latex binding agents and heat cured. The mat is in roll form and cut to the desired length at the site of installation.

U.S. Pat. No. 5,673,521, discloses a rolled roof vent comprising a continuous, indeterminate-length rolled web composed of a series of sequentially-thermoformed integral longitudinal sections of thermoformable material. Each section has a plurality of incompressible space elements projecting in spaced relation from the web for spacing the web from the roof when installed thereon. Screening is interposed among the space elements lengthwise of the web on opposite sides of its longitudinal median to prevent ingress of foreign objects.

During manufacturing the thermoformed vent is rolled into a spiral roll and shipped to the site of installation. At the installation site, the vent is disposed with its spacer elements facing downward, cut to the desired length, and nailed in place. Subsequently, the roof caps are applied onto the vent.

U.S. Pat. No. 6,039,646 discloses a ventilating cap for covering a vent opening wherein the ventilating cap is made of a corrugated material comprising five or more four-foot panels each connected to an adjacent panel through transverse folds and bundled together in a roll for transport. The transverse folds are created in the corrugated material by compressing with a die at lines separating the sections. As the die is pressed against the corrugated material the same is limitedly crushed thereby narrowing the thickness between the sections/panels. This allows folding the sections/panels over each other after which the folded sections/panels are held together by fastening bands prior to installation. A fastening band extends around all but one of the panels and a second fastening band extends around all of the panels thereby holding the panels together for transport. After the bundle is placed on the roof of a building, the second fastener is released to release the first panel, while the remaining panels remain bundled together by the other fastener.

U.S. Pat. No. 6,233,887 discloses a rollable shingle-over roof ridge vent comprising: a top panel portion; a plurality of support members depending downwardly from the top panel portion; first and second undulating sidewalls downwardly depending from the first and second lateral edges of the top panel portion, with each of the sidewalls being non-planar and undulating along its respective lateral edge such that the roof ridge vent may be flexibly rolled lengthwise into a spiral roll prior to installation and further may be unrolled lengthwise during installation over the peak of the roof The method of preparation of the roof ridge vent includes bonding sections of the roof ridge vent, by heating adjacent ends of successive sections above the melting point of the thermoplastic material, abutting the heated ends, then allowing the ends to cool below the melting point of the thermoplastic material. A variety of additional ways for joining successive sections of roof ridge vent are also disclosed including the use of interlocking fasteners, screws and nuts, split fasteners, self-tapping screws, glue or bonding agents, clips, rivets, staples, push-in split fasteners, and the like.

The above-mentioned roof ridge vents in the form of rolls or rollably packaged configurations substantially improve handleability and economy in comparison to roof ridge vent shingles which need to be individually disposed and installed over a roof ridge. Handling rolls, especially on a steep roof, is difficult because of the tendency of the rolls to slip by gravity towards the lower part of the roof. Alignment of the roll so that the connected panels/sections line up precisely on the peak of the roof is also difficult, requiring two workers: one to do the alignment and the other to hold on to the roll to prevent its slipping off the roof.

The present invention provides an improvement in the configuration of the roof ridge vent wherein sections of the vent, connected by soft hinges are fan folded into a stacked configuration. The stack is pulled form one end allowing the vent to unfold and lay flat on the ridge during installation. This and other properties of the fan fold vent will be described as the description proceeds.

SUMMARY OF THE INVENTION

The present invention provides an improvement in the configuration of a fan fold vent wherein sections of the vent, connected by soft, pliable hinges without memory and alternating from top surface to bottom surface of the sections, are folded into stacked configuration during the manufacturing process and transportation to the site of installation. At the site of installation, the stack is pulled from one end allowing the vent to unfold and lay flat on the ridge. The fan fold vent, comprising multiple sections, is designed to cover the opening at the peak of a roof to provide ventilation of the attic space while preventing entry of water, snow and insects thereinto. Each of the sections is flexible and can be contoured to a roof having about 10° to 45° or more at its peak. Each of the sections can be contoured to a central point line and at two parallel lines spaced from the central point line running longitudinally of the section. The section has a top face or surface facing the shingles and a bottom face or surface facing the attic space. The bottom surface is supported by Z-shaped and Y-shaped supports spaced from and alternating each other throughout the length of the panel.

Rows of vent slots and slats integral with the section run longitudinally on two sides of the section to provide for ventilation. In a preferred embodiment, the individual slots and slats are of trapezoidal configuration having two parallel sides of different length. The longer length side of the slats faces the outside while the longer length side of the slots faces the attic side. This configuration prevents entry of water, snow, ice and insects into the attic space while enhancing the flow of static air out of the attic space. Other longitudinal configurations, such as rectangular and elliptical configurations, are contemplated.

A vertical, solid exterior baffle integral with the rows of slots and slats and running parallel thereto on the two sides of the panel is provided to achieve the Bernoulli effect whereby, when the external wind impacts on the baffle, the wind is deflected towards the peak of the roof creating a vacuum over the rows of slots and slats. The exterior baffle extends into a baffle extender, and integral therewith, which is slightly higher than the height of the baffle extender and is at an angle of about 130° to about 160°, and preferably about 145° from the plane of the exterior baffle. The baffle extender further enhances the vacuum effect of the exterior baffle.

Gutters, integral with the rows of slats and the exterior baffle, lead water, which passes through drain holes built into the lower row of slats, towards one or the other end of the section.

DETAILED DESCRIPTION OF THE INVENTION

The present invention is directed to a fan fold vent comprising individual vents which are connected by a soft hinge allowing stacking of the individual vents into stacked configuration. The soft hinges connecting the individual vents are staggered/alternated: one hinge is on the top of the vent and the other hinge is on the bottom of the vent at the next junction. The staggered hinges allow stacking of the individual vents in rectangular configuration. The soft hinge does not have a built-in memory so that the individual vents lay on top of each other without the need to use straps or other means to maintain them in this configuration. As opposed to some prior art vents where the connecting portions between individual vents are placed on top, bottom or juxtaposition of the individual vents requiring straps to hold the vents in stacked or rolled configurations, the staggered positions of the hinges enable stacking the individual vents on top of each other without any restrictive means to prevent the vents from unfolding.

Figure 1:
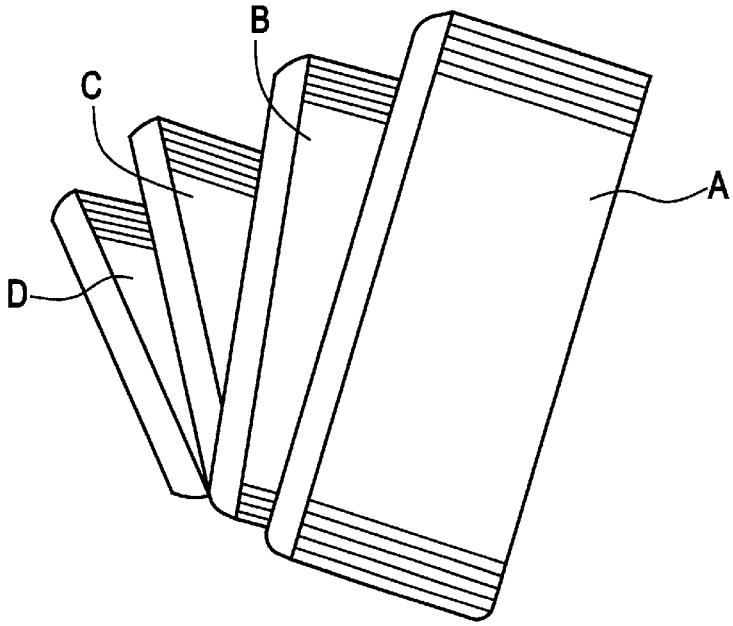
FIG. 1 is a perspective view of four sections of the fan fold vent of the present invention positioned in a fan fold configuration.

FIG. 1 is a perspective view of four sections of the fan fold vent of the present invention positioned in a fan configuration, the individual sections being denoted by the letters A, B, C and D. The number of sections is limited only by practical considerations, such as the length of the roof ridge and the total weight of the sections. The total length of the sections is typically about 20 feet.

Figure 2:
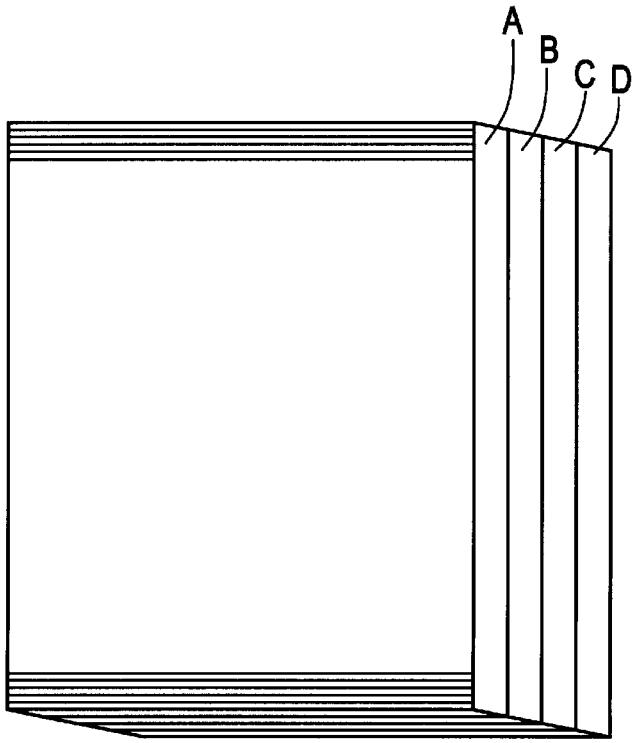
FIG. 2 is another perspective view of the four sections of the fan fold vent in stacked position.

FIG. 2 is another perspective view of four sections of the fan fold vent in stacked positions wherein the individual sections are again denoted by the letters A, B, C and D. The stack can be easily carried to the roof ridge and installed by one installer. The total length of the fan fold vent required is typically requested by the building contractor/installer so that the installation process is facilitated by the manufacturer.

Figure 3:
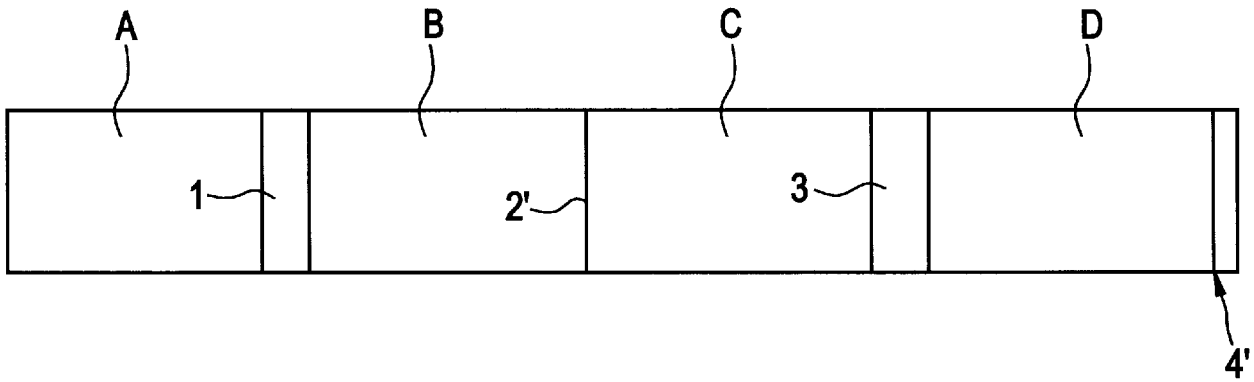
FIG. 3 is a schematic representation of the top plan view of the four sections of the fan fold vent joined together by soft hinges.

FIG. 3 is a schematic representation of the top plan view of four sections of the fan fold vent joined together by soft hinges.

Figure 4:
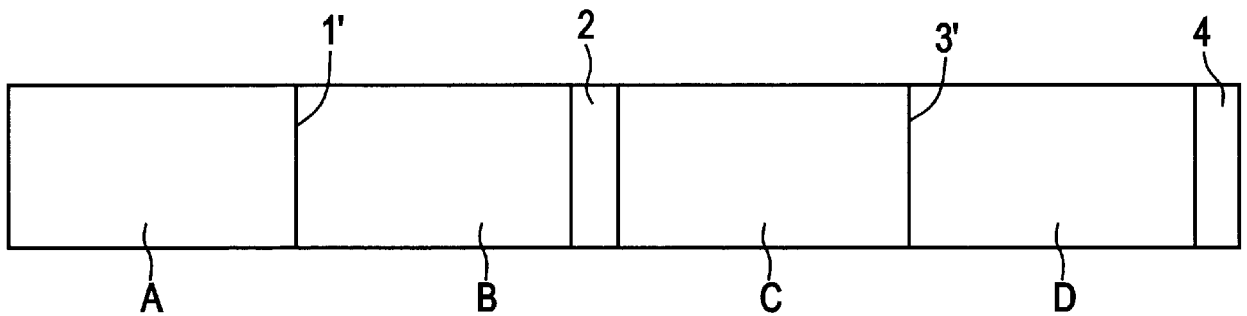
FIG. 4 is a schematic representation of the bottom plan view of the four sections of the fan fold vent.

FIG. 4 is a schematic representation of the bottom plan view of the four sections of the fan fold vent joined together by soft hinges.

In each of the FIG. 3 and FIG. 4 representations, the individual sections are denoted by the letters At B, C and D.

The soft hinges connecting the individual sections are alternated: one hinge being on the top surface and the other hinge being on the bottom surface of the vent. Accordingly, hinge number 1 connecting sections A and B is on the top surface while there is no hinge on the bottom surface of sections A and B. The joining line between sections A and B in the bottom plan view is marked by the numeral 1'. Similarly, sections B and C are not connected on the top surface, the joining line being marked with the numeral 2', but are connected by soft hinge 2 on the bottom surface. The next two sections C and D are connected on the top surface by soft hinge number 3, while there is no hinge present on the corresponding joint marked 3'.

On the end Section D the soft hinge 4 is on the bottom surface.

Figure 5:
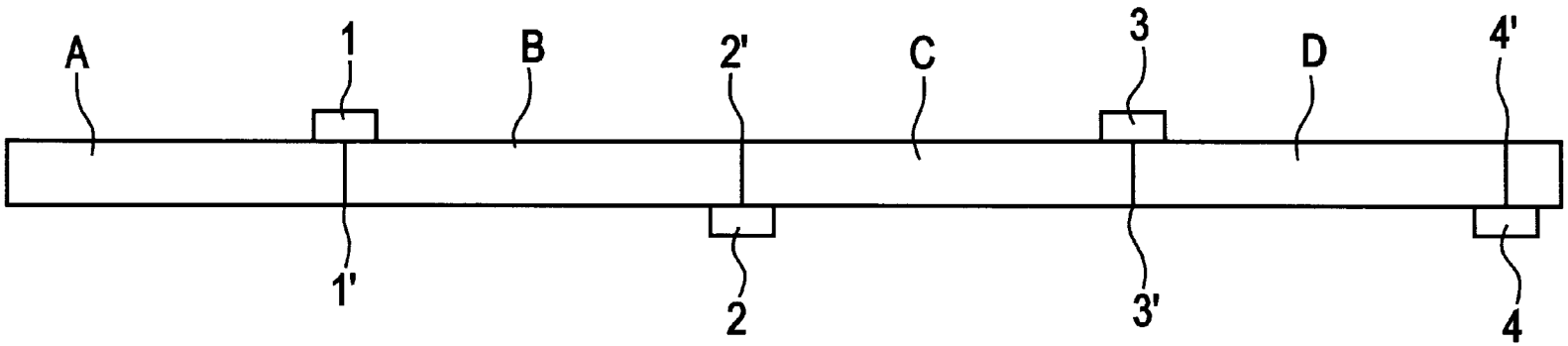
FIG. 5 is a schematic representation in side-elevational view of the four sections of the fan fold vent.

FIG. 5 is a schematic representation in side-elevational view of the four sections A, B. C and D of the vent wherein: the soft hinges are dented by the numerals 1 and 3 on the top surface and 2 and 4 on the bottom surface. The thickness of the hinges are exaggerated for illustrating purposes. It is to be noted that the soft hinges, as shown, cover relatively small portions of the sections A, B, C and D. The hinges may cover large portions of the adjacent sections up to but not including the next joint so that the alternating portions of the hinges on top surface versus the bottom surface is maintained. This alternating positioning of the hinges allow folding the sections front-to-front/back-to-back.

The soft hinges are made of thin, pliable, polymeric material, such as polyethylene or polypropylene so that the individual sections of the vent may be folded on top of each other without resistance. The soft hinges are preferably of thermoplastic material to allow fusing of the same to the individual sections. Other methods of joining the hinges to the individual sections include gluing or bonding, rivets and staples. Any methods used in joining the soft hinges to the individual sections should produce a thin, low profile so that the joints do not interfere with the folding/stacking of the sections.

An individual vent portion of the fan fold vent will now be described with special reference to U.S. Pat. No. 5,971, 848 which is incorporated herein by reference in its entirety.

Figure 6:
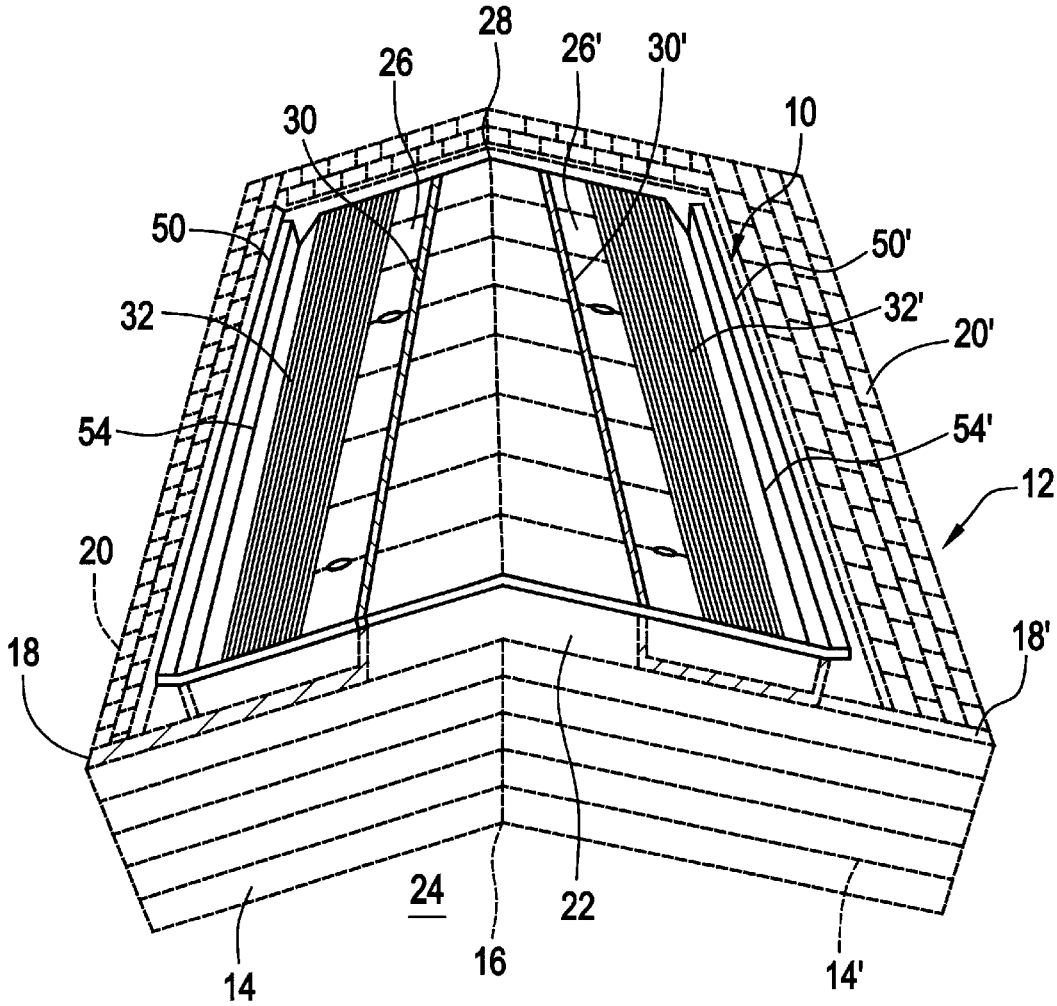
FIG. 6 is a perspective view of one section of the fanfold vent of the present invention mounted on a section of a building roof.

FIG. 6 is a perspective view of one section of the fan fold vent 10 mounted in a section of a building roof 12. Building roof 12 comprises: a plurality of cross-beams 14 and 14' joined together at 16 to form the structural support for building roof 12. Plywood decking 18 and 18' are laid over the cross-beams. The plywood decking is covered with shingles 20 and 20'. The plywood decking and covering shingles on the plywood decking do not completely cover the roof, at the ridge of the roof there is an opening or gap 22 which serves as an exit for air from the attic space 24. The gap exists between each pair of cross-beams defining a continuous space under the peak of the roof so that the attic air can be vented to the outside. While the gap would provide for maximum ventilation of the attic space, it would allow entry of rain, snow, insects and debris to enter into the attic space. To prevent such entry, as well-known in the art, a ridge ventilator covers the gap and at least partially overlaps the plywood deck and shingles of the roof. The overlap ensures that precipitation does not migrate toward the peak of the roof and enter the attic space.

The present inventive fan fold vent 10 covers the gap at the peak of the roof and provides for proper ventilation of attic space 24 while preventing entry of moisture, birds and insects thereinto without substantially affecting the maximum ventilating capability of the gap if left uncovered. This, and other aspects of the inventive fan fold vent will be explained as the description thereof proceeds.

The fan fold vent of the present invention comprises a unitary panel 26 which is disposed over the ridge of the roof. The panel is provided as a flat sheet material which is to be contoured to the configuration of the roof angle, which can be of about 10° to 45° or more since the plastic material of which the panel is made can be contoured to any desired angle on the roof. Accordingly, the fan fold vent of the present invention is an initially flat sheet having top face 27 and bottom face 27'. The panel is bent at central point line 28 so that the panel conforms to the peak of the ridge. To obtain a smooth configuration, fan fold vent 10 may be bent not only at central point line 28 but also at linear point lines 30 and 30'.

Figure 7:
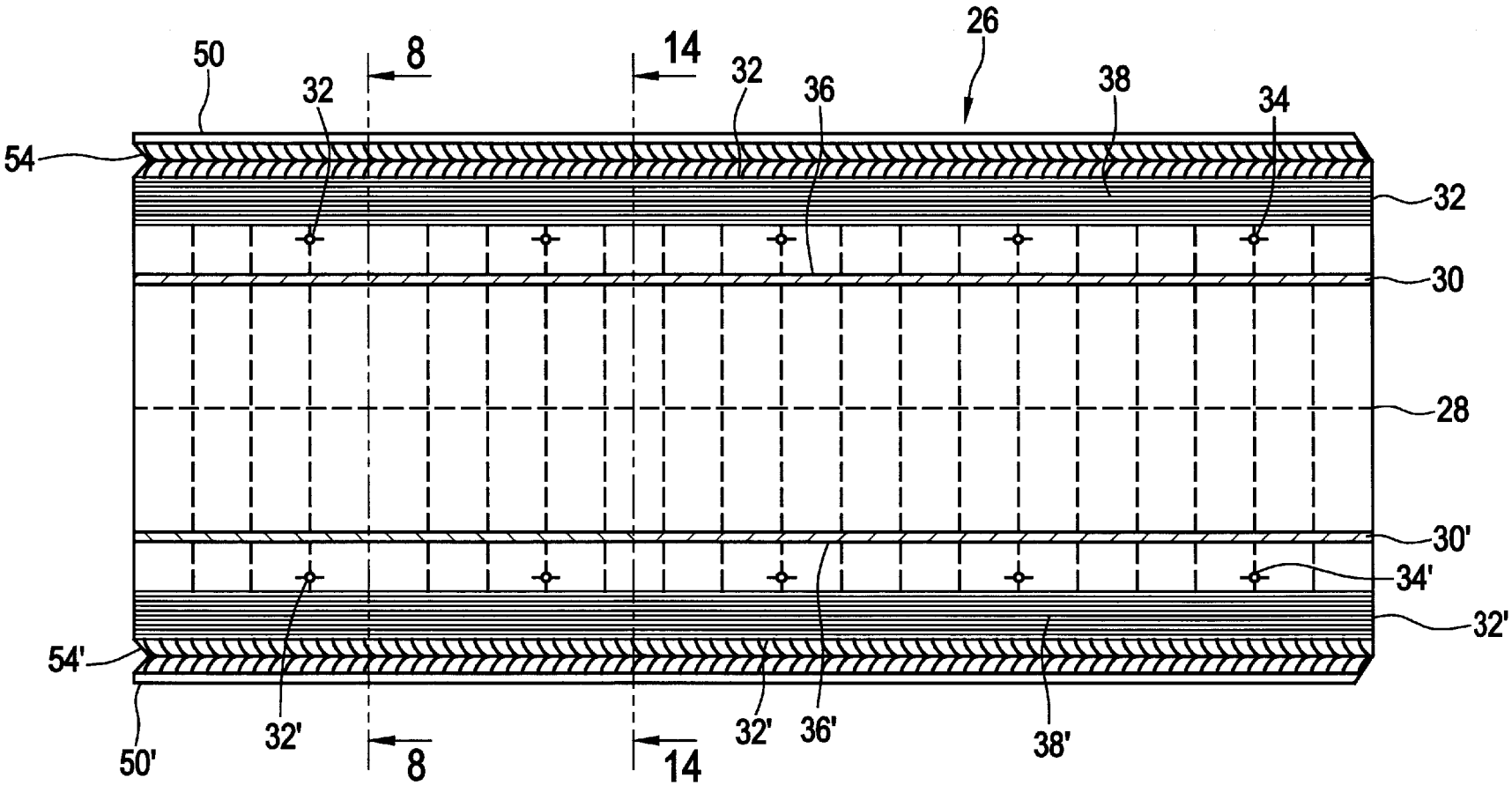
FIG. 7 is a top plan view of one section of the vent shown in FIG. 6.
Figure 9:
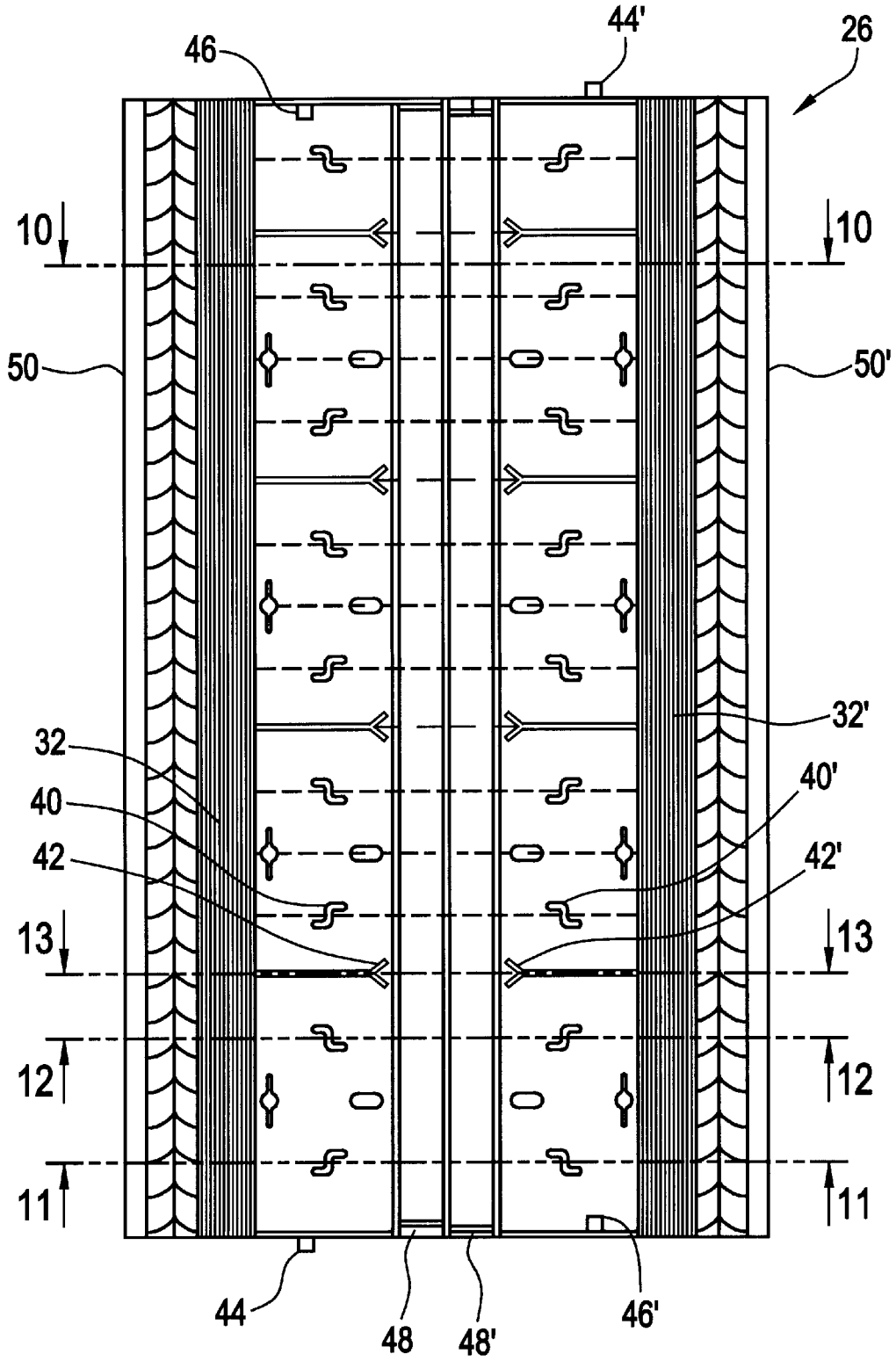
FIG. 9 is a bottom plan view of the vent shown in FIG. 6.

Panel 26 is shown in FIGS. 7 and 9 having a top surface and a bottom surface. Shown in FIG. 7 is the top of the panel facing the outside and illustrating the various portions and attributes thereof. Typically, the panel has a dimension of about 48" in length and about 15" in width. It embodies longitudinally oriented vent slots 32 and 32' which run through the entire length of the panel. A plurality of tack holes 34 and 34' are marked for facilitating installation, which run parallel to vent slots 32 and 32'. The tack holes are provided for initially positioning the panel over the roof ridge. Nail lines 36 and 36' serve to securely attach the panel to the roof using nails as final attachment means. Typically, linear point lines have a width of about 0.25" at which the panel is weakened allowing for easy flexibility so that the panel may conform to the underlying configuration of the roof structure. Drain slots 38 and 38' are spaced from each other at a distance of about 2".

FIG. 9 shows the bottom face or surface of panel 26 which surface faces the attic space and the roof to which the panel is secured. In the drawings the numerals 40 and 40' denote Z-shaped supports spaced at intervals to support panel 26. The Z-shaped supports are placed at about 4" from each other. In a panel having a length of 48", therefore, there are 12 Z-shaped supports. Panel 26 is further supported by Y-shaped gussets 42 and 42' positioned between each pair of Z-shaped supports. Y-shaped gussets are also spaced at about 4" from each other. In a panel having a length of 48", therefore, there are 12 Y-shaped gussets. As a result of spacing the Z-shaped supports and Y-shaped gussets as indicated, panel 26 is supported against the roof at every two-inch interval.

Panel 26 is provided with a pair of slots and pins at both end edges of the panel: one end edge has pin 44 and slot 46 while the other end edge has pin 44' and slot 46'. The pins and slots enable the positioning and connecting of one panel to the next panel during the installation process. As discussed earlier, sections/panels are joined by soft hinges which prevent leakage between them.

To further insure against leakage between the joints of two panels, panel 26 is also provided with a pair of hinges 48 and 48'. The hinges at both end edges of the panel are designed to sealingly cover the joints between two adjacent panels at the center point line 28 and immediate area on each side thereof. This area running longitudinally of the panel covers the opening or gap 22 in the peak of the roof. An overhang extension can be provided on one end of the panel in order to help further seal adjacent panels and prevent leakage.

Figure 8:
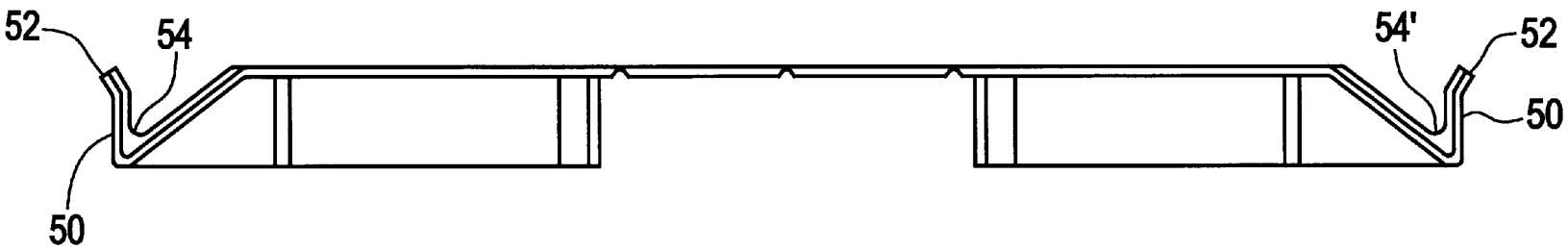
FIG. 8 is a cross-sectional view of the vent taken along the line of 8—8 of FIG. 7.

Vent slots 32 and 32' as shown in FIGS. 6, 8 and 9 run horizontally at the two longitudinal side of panel 26 in a plurality of rows to provide for ventilation and to prevent ingress of insects into the attic space. The number of rows may be of from about 2 to about 10. The total width of the rows is typically about 1.5" while the open width is about ⅛" between the rows.

Figure 10:
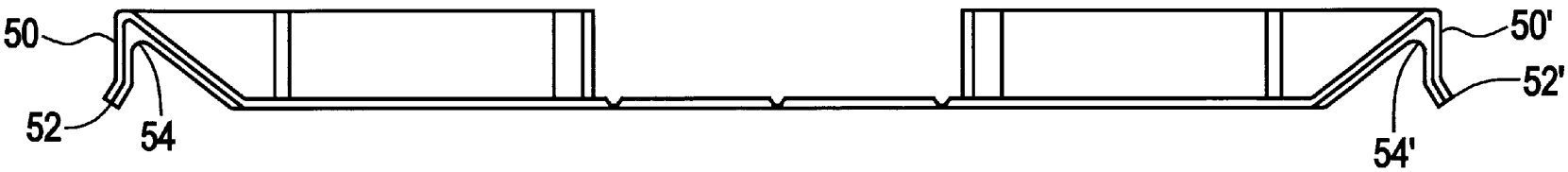
FIG. 10 is a cross-sectional view of the vent taken along the line 10—10 of FIG. 9.

Referring to FIGS. 6, 7, 8, 9 and 10, vertical exterior baffles 50 and 50' unitary with panel 26 and running longitudinally and parallel to vent slots 32 and 32' is provided for the purpose of inducing the Bernoulli effect. As the external wind impacts on the vertical wall, it will be deflected upward towards the peak of the roof. As the wind passes over the rows of vents it will create a vacuum drawing stagnant air out from the attic space. The height of the exterior baffles is typically about 0.8". In addition, the exterior baffles 50 and 50' may include baffle extenders 52 and 52' the heights of each of which is about ¼" and are at an angle of about 45° from the plane of the vertical baffles. The baffle extenders further improve the vacuum effect of the vertical exterior baffles. It is to be noted that vertical exterior baffles 50 and 50' and baffle extenders 52 and 52' in FIG. 10 are shown in a cross-sectional bottom view so that their orientation is opposite to those shown in FIGS. 6, 7, 8 and 9.

In FIGS. 6, 7 and 8 there are shown gutters 54 and 54' positioned between the plane of vent slots 32 and 32' and the plane of the vertical exterior baffles 50 and 50'. The plurality of drain slots 38 and 38' allow water to pass therethrough and collects in the gutters from which, in turn, the water runs down onto shingles 20 and 20'.

Reference is now being made to the supporting structure of the fan fold vent of the present invention. As shown in FIG. 9, the bottom plan view of the fan fold vent, the support structure includes: a plurality of Z-shaped supports as denoted by 40 and 40'; a plurality of Y-shaped gussets as denoted by 42 and 42'; and nails in nail lines 36 and 36' located 2" from the edge of panel 26, excluding the venting section, on both sides of the ridge.

Figure 11:
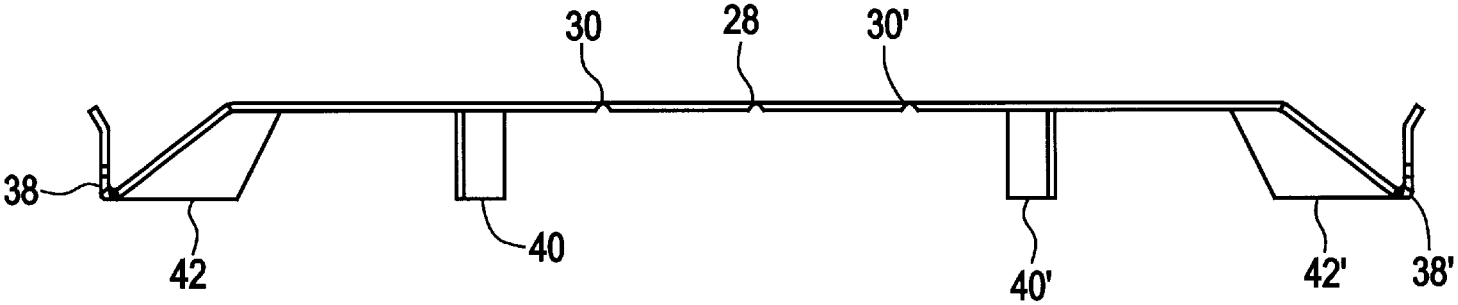
FIG. 11 is a cross-sectional view of the vent taken along the line 11—11 of FIG. 9.
Figure 12:
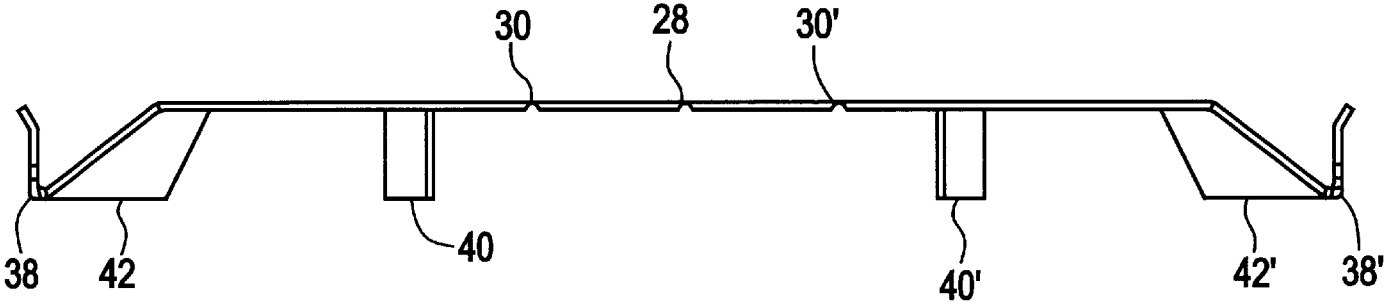
FIG. 12 is a cross-sectional view of the vent taken along the line 12—12 of FIG. 9.

FIGS. 11 and 12 show cross-sectional views of the fan fold vent taken along the lines 11—11 and 12—12 in FIG. 9 respectively. Z-shaped supports 40 and 40' are shown in FIG. 11 oriented towards the longitudinal edge of the ridge, while in FIG. 12 the Z-shaped supports 40 and 40' are oriented towards the center of the ridge.

Figure 13:
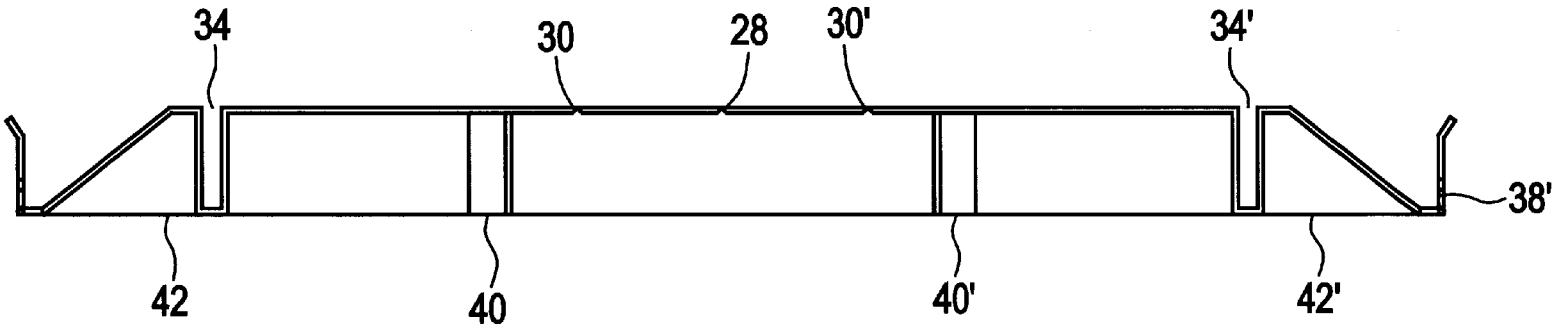
FIG. 13 is a cross-sectional view of the vent taken along the line 13—13 of FIG. 9.

FIG. 13 is a cross-sectional view of the fan fold vent, taken along the line 13—13 of FIG. 9, showing: Y-shaped gussets 42 and 42'; tack holes 34 and 34'; and nail lines 30 and 30'. When installed, Y-shaped gussets, tacks positioned in tack holes and nails passed through the panel 26 at nail lines and into the underlying shingles 20 and 20' and plywood decking 18 and 18' provide for secure attachment of the plastic ridge vent of the present invention.

Figure 14:
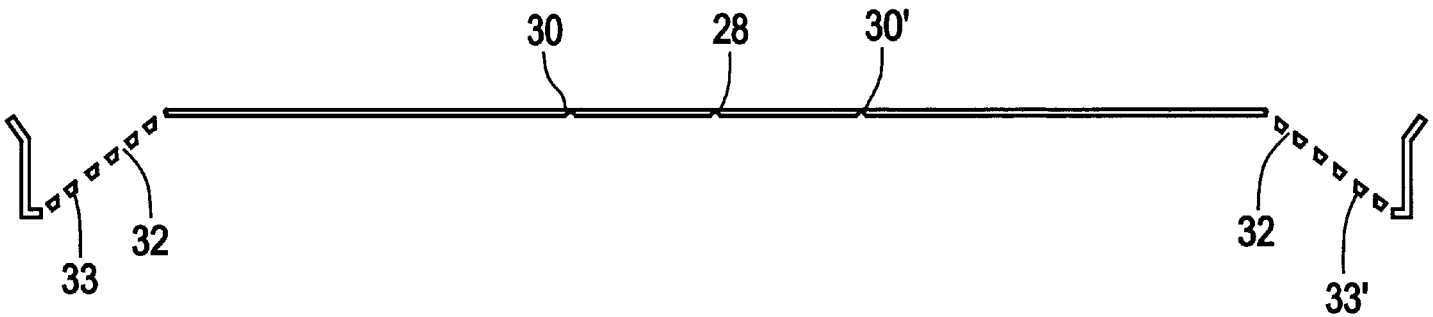
FIG. 14 is a cross-sectional view of the vent showing the vent slots opening and vent slats and typical dimensions of the vent.

FIG. 14 is a cross-sectional view of the fan fold vent of the present invention taken along the line 14—14 of FIG. 7, but showing only the vent slots openings 32 and 32' and the vent slats 33 and 33'. The total width of the fan fold vent including the vent slots, vent slats, vertical exterior baffles and baffle extenders is about 14.9". The width of the panel, not including the vent slots and vent slats, is about 11.6". The distance between the linear point line 30 and linear point line 30' is about 3.0". The height of the exterior baffle together with the baffle extender is about 1.0".

Figure 15:
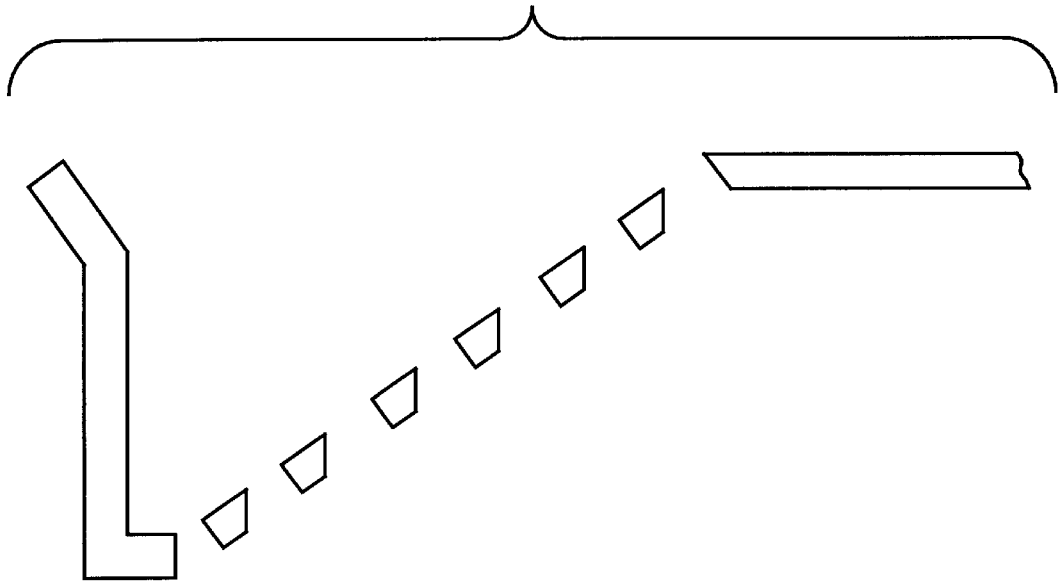
FIG. 15 shows the vent slots openings shown in FIG. 14.
Figure 16:
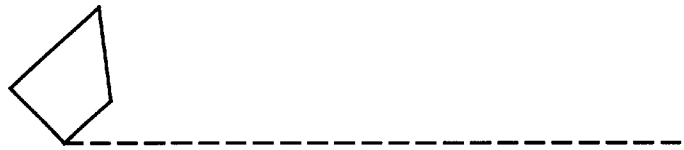
FIG. 16 shows the orientation of the vent slots.

Referring now to FIGS. 15 and 16 which show one feature of the present invention, there are shown 6 slots and 6 slats alternating and running longitudinally at the two side edges of the panel between the solid portion of the panel and the vertical exterior baffle. Each individual slat is oriented 90° from the horizontal plane and has a width of about 0.086" and a length along its longest side of about 0.125". The smallest dimension of the slot is also of about 0.125" which faces the outside environment. The side of the slot facing the attic side is larger. Both the slats and the slots are configured as trapezoidal, having two parallel sides and the other two sides being non-parallel to each other. While the longest side of the slats faces the outside, the longest side of the slots faces the attic side. As a result, snow, rain and insects are essentially prevented form entering through the slots and static warm air has a larger surface area in the underside of the vent to be expelled through the vent. The vacuum effect of the wind, which passes over the vertical exterior baffle and baffle extender, is greatly increased with the configuration of the slot/slat combination. As a result, warm air is more readily expelled from the attic space.

The fan fold of the present invention may be manufactured from polymeric materials well-known in the building industry. Preferred polymeric materials include polyethylene, polypropylene and polyvinyl chloride and copolymers thereof. Recycled polymeric materials can be employed.

Having described the invention with reference to its preferred embodiments, it is to be understood that modifications within the scope of the invention will be apparent to those skilled in the art.

LIST OF PARTS

| | |
|---|---|
| Individual sections of the fan fold vent | A, B, C, D |
| Soft hinges connecting the individual sections | 1, 2, 3, 4 |
| Details of an individual section of the fan fold vent, generally designated | 10 |
| Section of building roof | 12 |
| Cross-beams in building roof | 14 and 14' |
| Cross-beams joined together at peak | 16 |
| Plywood decking | 18 and 18' |
| Shingles | 20 and 20' |
| Opening or gap below the ridge of the roof | 22 |
| Attic space | 24 |
| Unitary panel | 26 |
| Top face or surface of panel | 27 |
| Bottom face or surface of panel | 27' |
| Central point line in panel | 28 |
| Linear point lines | 30 and 30' |
| Vent slots | 32 and 32' |
| Vent slats | 33 and 33' |
| Tack holes | 34 and 34' |
| Nail lines | 36 and 36' |
| Drain slots | 38 and 38' |
| Z-shaped supports | 40 and 40' |
| Y-shaped gussets | 42 and 42' |
| Pins at end edges of panel | 44 and 44' |
| Slots at end edges of panel | 46 and 46' |
| Hinges at end edges of panel | 48 and 48' |
| Vertical exterior baffles | 50 and 50' |
| Baffle extenders | 52 and 52' |
| Gutters | 54 and 54' |

What is claimed is:

1. A fan fold vent for covering the ridge of a roof having an opening therein for allowing ventilation of static air from an attic space of a building, adjustable to accommodate a variety of roof pitches and directs the flow of static air from the attic space to the outside environment comprising:

multiple vent sections having top and bottom surfaces;

soft pliable hinges connecting said multiple vent sections allowing the sections to fold on top of each other and form a stack for easy transportation and handling;

wherein said soft, pliable hinges are staggered at each junction of two vent sections, one hinge being on the top surfaces at the junction of two vent sections and one hinge being on the bottom surface at the junction of the next two vent sections; and wherein each of said vent section comprises:

a unitary panel of semi-rigid plastic material having a length and a width and top and bottom faces and being flexible in a lateral direction so as to be adjustable to the configuration of the roof;

support structure in the bottom face of said unitary panel to prevent collapse or warping over said roof;

ventilation means for guiding air from the attic space to the exterior and for creating a vacuum over said ventilation means to enhance flow of static air from the attic space comprising:

rows of vent slots and slats integral with said panel running longitudinally on two sides of the length of said panel; and two vertical exterior baffles integral with said rows of said vent slats and running parallel thereto to create a vacuum over the rows of slots and slats.

2. The fan fold vent ventilator of claim 1 wherein said slots and slats are of trapezoidal configuration having two parallel sides of different length in which the longer length of the slats faces the outside while the longer length of the slots faces the attic space for guiding air from the attic space to the exterior.

3. The fan fold vent of claim 1 wherein said vertical exterior baffles extend into baffle extenders and integral therewith which baffle extenders are slightly higher than the height of the baffles and each of which is at an angle of from about 130° to about 160° from the plain of the vertical exterior baffle.

4. The fan fold vent of claim 3 wherein each of said baffle extenders is at an angle of about 145° from the plane of the exterior baffle.

5. The fan fold vent of claim 1 wherein there are 3 to 10 rows of slots and slats.

6. The fan fold vent of claim 2 wherein each slat is oriented 90° from the horizontal plane, has a width of about 0.074"–0.63" and a length at its longest side of about 0.074"–0.63", and wherein each slot has a length at its shortest side, facing the outside, of about 0.074"–0.63", and has a length at its longest side of at least 0.074"–0.63".

7. The fan fold vent of claim 1 further comprising drain slots in said ventilation means.

8. The fan fold vent of claim 1 further comprising a pair of hinges at both end edges of said panel and a pair of slots and pins at both end edges of said panel to sealingly attach one panel to the next panel upon installation of the fan fold vent.

9. The fan fold vent of claim 1 made of polymeric material.

10. The fan fold vent material of claim 9 wherein said polymeric material is selected form the group consisting of polyethylene, polypropylene and polyvinyl chloride and copolymers thereof.

11. A fan fold vent for covering the ridge of a roof having an opening therein for allowing ventilation of static air from an attic space of a building, adjustable to accommodate a variety of roof pitches and directs the flow of static air from the attic space to the outside environment comprising:

multiple vent sections having top and bottom surfaces;

soft pliable hinges connecting said multiple vent sections allowing the sections to fold on top of each other and form a stack for easy transportation and handling;

wherein said soft, pliable hinges are staggered at each junction of two vent sections, one hinge being on the top surfaces at the junction of two vent sections and one hinge being on the bottom surface at the junction of the next two vent sections; and wherein each of said vent section comprises:

a unitary panel of semi-rigid plastic material having a length and a width and top and bottom faces and being flexible in a lateral direction so as to be adjustable to the configuration of the roof;

support braces spaced throughout the length of the panel supporting the panel at the bottom face to prevent collapse or warping over said roof thereof;

ventilation means for guiding air from the attic space to the exterior comprising:

rows of vent slots and slats integral with said panel running longitudinally on two sides of the length of said panel, said slots and slats being of trapezoidal configuration having two parallel sides of different length in which the longer length of the slats faces the outside while the longer length of the slots faces the attic space for guiding air from the attic space to the exterior;

vertical exterior baffles integral with the rows of slats and running parallel thereto on both sides of the panel and extending into baffle extenders, said baffle extenders being integral with said baffles, are slightly higher than the height of the baffles and each of which is at an angle of from about 130° to about 160° from the plain of the vertical exterior baffle; and gutters integral with the rows of slats and the exterior baffles to lead water away from under the rows of slats and slots.

12. The fan fold vent of claim 11 wherein said support braces are Z-shaped and Y-shaped.

13. The fan fold vent of claim 11 wherein each of said baffle extenders is at an angle of about 145° from the plain of the exterior baffle.

14. The fan fold vent of claim 11 further comprising drain slots in said ventilation means.

15. The fan fold vent of claim 11 further comprising a pair of hinges at both end edges of said panel and a pair of slots and pins at both end edges of said panel to sealingly attach one panel to the next panel upon installation of the fan fold vent.

16. The fan fold vent of claim 11 made of polymeric material.

17. The fan fold vent of claim 16 wherein said polymeric material is selected from the group consisting of polyethylene, polypropylene and polyvinyl chloride copolymers thereof.

18. The fan fold vent of claim 11 wherein said panel is contoured at a central point line running longitudinally of the panel.

19. A method of installing a fan fold vent for covering the ridge of a roof having an opening therein for allowing ventilation of static air from an attic space of a building comprising the steps of:

a) providing a fan fold vent comprising:

multiple vent sections having top and bottom surfaces;

soft pliable hinges connecting said multiple vent sections allowing the sections to fold on top of each other and form a stack for easy transportation and handling;

wherein said soft, pliable hinges are staggered at each junction of two vent sections, one hinge being on the top surfaces at the junction of two vent sections and one hinge being on the bottom surface at the junction of the next two vent sections; and wherein each of said vent section comprises:

a unitary panel of semi-rigid plastic material having a length and a width and top and bottom faces and being flexible in a lateral direction so as to be adjustable to the configuration of the roof;

support braces spaced throughout the length of the panel supporting the panel at the bottom face to prevent collapse or warping over said roof thereof;

ventilation means for guiding air from the attic space to the exterior comprising:

rows of vent slots and slats integral with said panel running longitudinally on two sides of the length of said panel, said slots and slats being of trapezoidal configuration having two parallel sides of different length in which the longer length of the slats faces the outside while the longer length of the slots faces the attic space for guiding air from the attic space to the exterior;

vertical exterior baffles integral with the rows of slats and running parallel thereto on both sides of the panel and extending into baffle extenders, said baffle extenders being integral with said baffles, are slightly higher than the height of the baffles and each of which is at an angle of from about 130° to about 160° from the plain of the vertical exterior baffle; and gutters integral with the rows of slats and the exterior baffles to lead water away from under the rows of slats and slots;

b) positioning the stacked fan fold vent onto the starting end of the peak of the roof;

c) unfolding the stacked fold vent to cover parts or all of the roof ridge;

d) adjusting the sections of the fan fold vent to align to each other and to cover the peak of the roof ridge; and e) nailing each of the sections of the fan fold vent to the underlying roof.

* * * * *